US006514138B2

(12) United States Patent
Estepp

(10) Patent No.: US 6,514,138 B2
(45) Date of Patent: Feb. 4, 2003

(54) DEMAND VENTILATION MODULE

(76) Inventor: Kevin Estepp, 9411 E. McLellan, Mesa, AZ (US) 85207

( * ) Notice: Subject to any disclaimer, the term of this patent is extended or adjusted under 35 U.S.C. 154(b) by 0 days.

(21) Appl. No.: 09/756,890

(22) Filed: Jan. 9, 2001

(65) Prior Publication Data

US 2002/0090908 A1 Jul. 11, 2002

(51) Int. Cl.[7] ..... F24E 7/007

(52) U.S. Cl. ..... 454/229; 454/233; 454/234; 454/236; 454/241

(58) Field of Search ..... 454/229, 231, 454/233, 234, 236, 241

(56) References Cited

U.S. PATENT DOCUMENTS

| | | | | | |
|---|---|---|---|---|---|
| 1,921,900 | A | * | 8/1933 | Wood | 454/234 |
| 3,363,531 | A | * | 1/1968 | Kohlmeyer et al. | 454/234 |
| 3,367,258 | A | * | 2/1968 | Erfeling | 454/234 |
| 4,210,278 | A | | 7/1980 | Obler | |
| 4,383,477 | A | | 5/1983 | Nilsson et al. | |
| 5,005,636 | A | * | 4/1991 | Haessig | 165/214 |
| 5,031,515 | A | * | 7/1991 | Niemela et al. | 454/236 |
| 5,881,951 | A | | 3/1999 | Carpenter | |
| 6,302,783 | B1 | * | 10/2001 | Vroege | 454/233 |

OTHER PUBLICATIONS

Trane Operation Maintenance,PCCB–M–1B, Penthouse Climate Changer, PCCB Models PCC–7, 14, PCC–18, 23, PCC–37, 52, and PCC–60, 74, Basic Casing Units and Exhaust Fan Economizer Units, Aug. 1992, pp. 1–30.

Honeywell, Economizer Systems Quick Selection Guide, pp. 1–4, 1998.

Honeywell, Fresh Air Economizer Systems Brochure, May 1998.

Semco Incorporated FV Preconditioner Series, FV1000, FV2000, FV3000, and FV5000 Owner Manual, pp. 1–15.

MicrMetl Installation Instructions for 1682/4682 Series, Form No. 1999–P, 1996, pp. 1–11.

MicroMetl Submittal Form No. 2004–1P, 03/96, Centrifugal Power Exhaust, Economizer and Modulating Economizer Controls for Carrier 48/50 HJ, TJ 50, HJQ 008–014 Units.

MicroMetl Submittal Form No. 2003–1P, 03/96, Centrifugal Power Exhaust, Economizer and Modulating Economizer Controls for Carrier 48/50 HJ, TJ 50HJQ 004–007 Units.

* cited by examiner

*Primary Examiner*—Jiping Lu
(74) *Attorney, Agent, or Firm*—Schmeiser, Olsen & Watts

(57) ABSTRACT

A demand ventilation module is provided for use with HVAC systems in order to ventilate inside space of a structure through an air pressure differential between return air and outside air. The demand ventilation module includes an integrated damper. The demand ventilation module can further include and an air restrictor plate that defines an air-restricting opening and an electronic control device capable of marking, setting, and/or storing air condition set-points for ventilation activation, and configured to facilitate ventilation control, economizer operation, and HVAC unit operation. The electronic control device is electrically connected to and controls the activation of an actuator in conjunction with inside and outside sensors that measure air conditions. The electronic control device can cause the actuator to automatically shift the damper in direct proportion to actual real-time air condition demands.

17 Claims, 7 Drawing Sheets

DEMAND VENTILATION MODULE

BACKGROUND OF THE INVENTION

1. Technical Field

This invention relates to heating, ventilation, and air conditioning (HVAC) systems. More specifically, the invention relates to a demand ventilation module.

2. Background Art

In an effort to provide maximum energy savings, many buildings are designed to be as airtight as possible. This is generally accomplished by limiting the amount of outside air infiltration. However, it has since been discovered that this tight building construction contributes significantly to the excessive build up of indoor air contaminants from various sources. These contaminants affect the health of building occupants resulting in what has become known as Sick Building Syndrome (SBS).

Various scientific studies concluded that buildings should be ventilated with a specific amount of outside air, based on occupancy and potential pollutant levels in the space, in order to allow the concentrations of indoor air pollutants to be reduced to acceptable levels. To this end, the American Society of Heating Refrigeration and Air Conditioning Engineers (ASHRAE) has established outdoor air standards that are usually adopted by most building codes and design engineers. Specifically, ASHRAE recommends ventilating buildings with different volumes of outside air based on a number of factors including potential pollutant levels and duration of occupant exposure encountered in specific applications.

To facilitate proper ventilation, previous strategies and products have been provided. A fixed air strategy has been provided to allow a fixed amount of outside air to infiltrate the building at all times through the HVAC system. This solution, however, results in excessive waste of energy when the room is not occupied and often overloads the HVAC system's capacity to regulate thermal comfort. In addition, the HVAC blower must run continuously to provide continuous ventilation. Furthermore, conventional room thermostats have only two fan options: "auto" and "on". Both options are selected manually via a switch on the thermostat. When in the "auto" position, the fan cycles on and off with the heating or cooling demand. This means the HVAC fan and associated ventilation stop when the heating or cooling demand is satisfied. But when the fan selector is "on", then the room is constantly ventilated, even when unoccupied. Thus, the fixed air strategy wastes energy and adds more heating or cooling load to the HVAC system.

One present control strategy regulates the amount of outside air infiltration based on "projected" occupancy. The concept of this strategy is to reduce unnecessary ventilation by estimating when the room is either not full or unoccupied. This control strategy requires someone to "project" or estimate expected occupancy levels and physically manipulate the control set point. This strategy often results in over-ventilating or under-ventilating the space when estimates are inaccurate.

Energy Recovery Ventilators have also been designed to force outgoing room air and incoming outside air to pass through an air-to-air heat exchanger before entering the air conditioning system. The idea of these products is to transfer heat from one air source (the room) to another (outside air) in order to reduce load on the HVAC system. These products operate constantly, whether the room is occupied or not, adding load to the system (over-ventilating) at times when the space is not fully occupied or unoccupied altogether. Additionally, there is no provision to control the HVAC fan operation.

A preferred strategy is known as "demand ventilation". This concept involves regulating ventilation dampers to provide the minimum required amount of outside air based on actual demand.

SUMMARY OF THE INVENTION

Accordingly, what is needed is a ventilation apparatus that overcomes the drawbacks of previous ventilation strategies and products, such as energy waste, increased heating or cooling load, increased maintenance and electrical consumption, noise, and the lack of HVAC operation control, through a demand ventilation module that regulates ventilation in direct proportion to actual occupancy of an inside space automatically. The invention solves these ventilation problems of previous strategies and products through a retrofit demand ventilation module for use with HVAC systems to facilitate compliance with ventilation requirements for acceptable indoor air quality. The demand ventilation module is an apparatus adaptable to be coupled to any location on a return portion of the HVAC system and capable of drawing and regulating outside air into the HVAC system and into the inside space of a structure by way of an air pressure differential between return air and the outside air. The demand ventilation module preferably includes a damper to regulate outside air infiltration into the HVAC system and into the inside space by way of the air pressure differential between the return air and the outside air. The damper is preferably integrated into an inner chamber of a self-contained housing. The housing includes an air outlet and an outside air inlet. The housing is easily adaptable to be coupled to any location on the return portion of the HVAC system.

The demand ventilation module preferably further integrates an air restrictor plate in conjunction with the damper that defines an air-restricting opening for more accurate control of the damper under low air velocity conditions. The demand ventilation module also preferably further integrates an electronic control device configured to facilitate ventilation control, economizer operation, and HVAC unit operation. The electronic control device is capable of setting and storing pre-set minimum absolute air condition differential parameters (air condition set-points) for ventilation activation. The electronic control device is electrically connected to and controls the activation of an actuator in conjunction with inside and outside sensors that measure air conditions. Upon receiving and comparing signals from the sensors to an air condition set-point, the electronic control device can cause the actuator to automatically shift the damper to any position in the damper stroke range in direct proportion to actual real-time air condition demands (e.g., occupancy levels of the inside space as evidenced by $CO_2$ levels).

Once installed, demand ventilation modules can also be electronically networked together into a system. This gives an operator the ability to fully control and monitor multiple HVAC units on multiple buildings at multiple sites via interfacing with the demand ventilation modules.

Thus, an advantage of this invention is that it is a universal module with adjustable damper positioning in order to accommodate various ventilation requirements subject to specific applications. Therefore, the invention is capable of retrofitting existing HVAC units and a wide variety of HVAC applications that have no or inadequate provisions for automated fresh air intake.

Another advantage of this invention is that it provides HVAC equipment with a state-of-the art computerized controls package capable of controlling, monitoring and trend logging virtually all aspects of HVAC operation, thereby providing maximum energy savings. Accordingly, the invention can provide continuous HVAC fan operation during occupied hours for continuous ventilation, while cycling the HVAC fan during unoccupied hours to save energy. The invention can also provide limitation of room temperature set-points to reduce abuse of energy and equipment, provide automatic setback temperature set-points during unoccupied hours for energy conservation, provide holiday and weekend scheduling in order to setback room temperatures or turn HVAC equipment off during unoccupied days, and provide alarms notifying building operators of conditions outside desired parameters.

Yet another advantage of this invention is that it can economize and provide "free" cooling when outdoor air enthalpy, or heat content, is low enough to supplement mechanical cooling by the HVAC system.

Because the invention is completely self-contained with integral control components, it provides a simple and low cost installation, and simple and reliable quiet operation with a minimum of moving parts, thereby virtually eliminating mechanical maintenance and resulting in drastically reducing first cost and energy consumption.

The foregoing and other features and advantages of the invention will be apparent from the following more particular description of the preferred embodiment of the invention, as illustrated in the accompanying drawings.

BRIEF DESCRIPTION OF THE DRAWINGS

The preferred embodiment of the present invention will hereinafter be described in conjunction with the appended drawings, where like designations denote like elements, and.

DETAILED DESCRIPTION OF THE INVENTION

Referring to FIGS. 1–7 generally, a demand ventilation module 2 is an apparatus adaptable to be coupled to any location on a return portion of HVAC system 100 and capable of drawing and regulating outside air into HVAC system 100 and into inside space of a structure by way of an air pressure differential between return air and the outside air in direct proportion to actual real-time air condition demand. Demand ventilation module 2 preferably includes a damper 62 for regulating outside air infiltration into HVAC system 100 and into the inside space by way of an air pressure differential between the return air and the outside air. Damper 62 that can be any configuration, such as conical, circular, elliptical, or triangular, any size, or the like, also depending on the ventilation application or configuration of the module. Damper 62 also could include multiple dampers.

Figure 5:
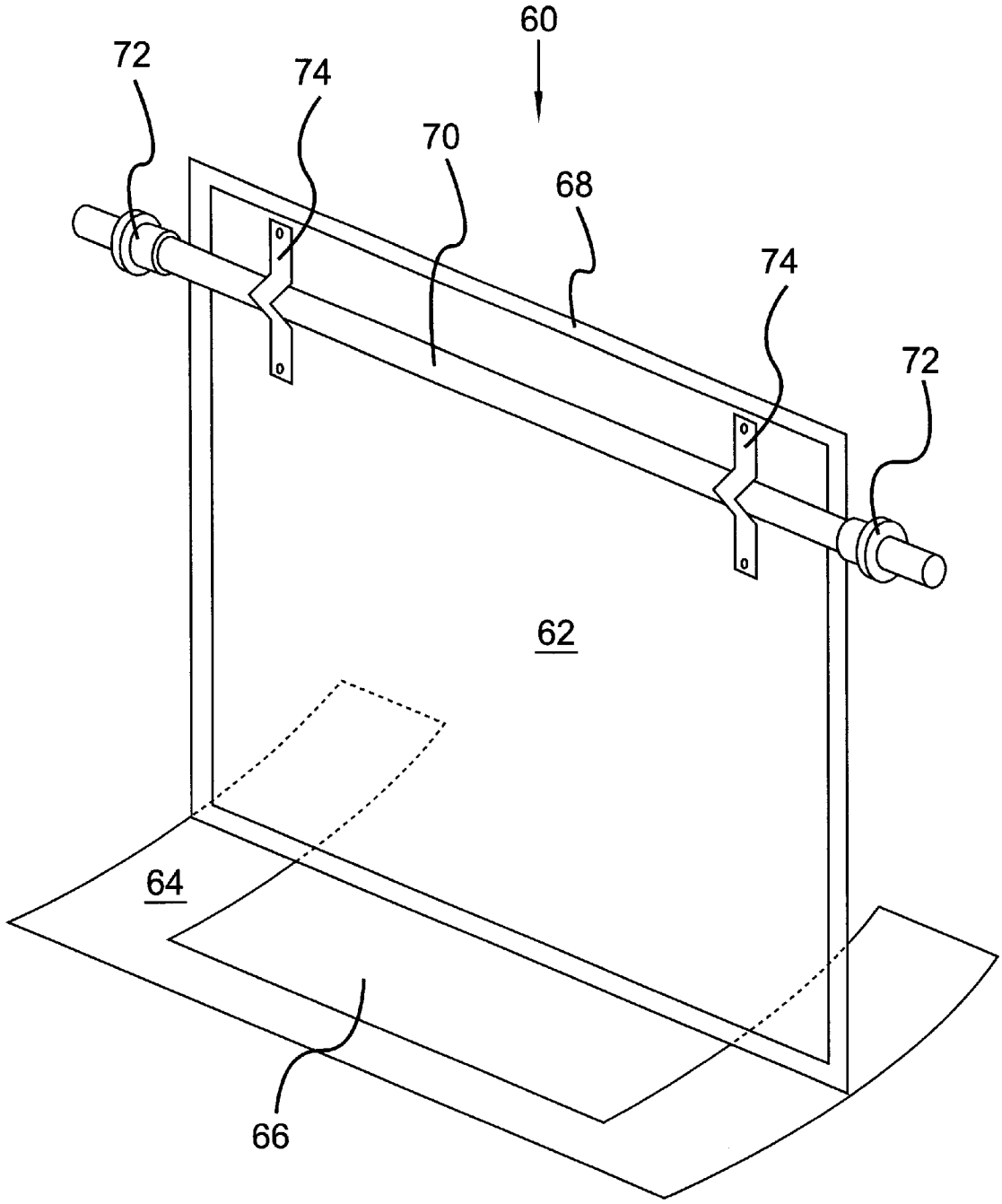
FIG. 5 is a three dimensional perspective view of the integrated damper assembly of the preferred demand ventilation module depicted in FIG. 1. p

Referring specifically to FIG. 5, demand ventilation module 2 preferably further includes an integrated damper assembly 60 that can include a damper seal 68, a damper shaft 70, damper shaft bushings 72, and damper shaft clamps 74. Damper seal 68 is along an outside perimeter of damper 62 and improves controllability of air flow through first stage 16 and second stage 18 of damper stroke range 14. Damper 62 is coupled to damper shaft 70 by damper shaft clamps 74, but could be coupled by welds, screws, or any other suitable mechanism. Damper shaft 70 is supported by damper shaft bushings 72 as hereinafter described. Integrated damper assembly 60 could include multiple assemblies depending on the ventilation application, and can be any configuration also depending on the ventilation application or configuration of the module.

Demand ventilation module 2 preferably can further include at least one air restrictor plate 64, as depicted in FIGS. 1, 2, 3, and 5. Preferred air restrictor plate 64 is formed along a first stage 16 of a damper stroke range 14 to mate with damper 62 as damper 62 rotates on its axis. Air restrictor plate 64 also defines an air-restricting opening 66 along the first stage 16 of the damper stroke range 14. Air restrictor plate 64 can be any configuration, size, or the like, including multiple air restricting plates, and define any opening configuration, size, or the like suitable for restricting air flow and controlling damper 62 under low air velocity conditions.

Figure 1:
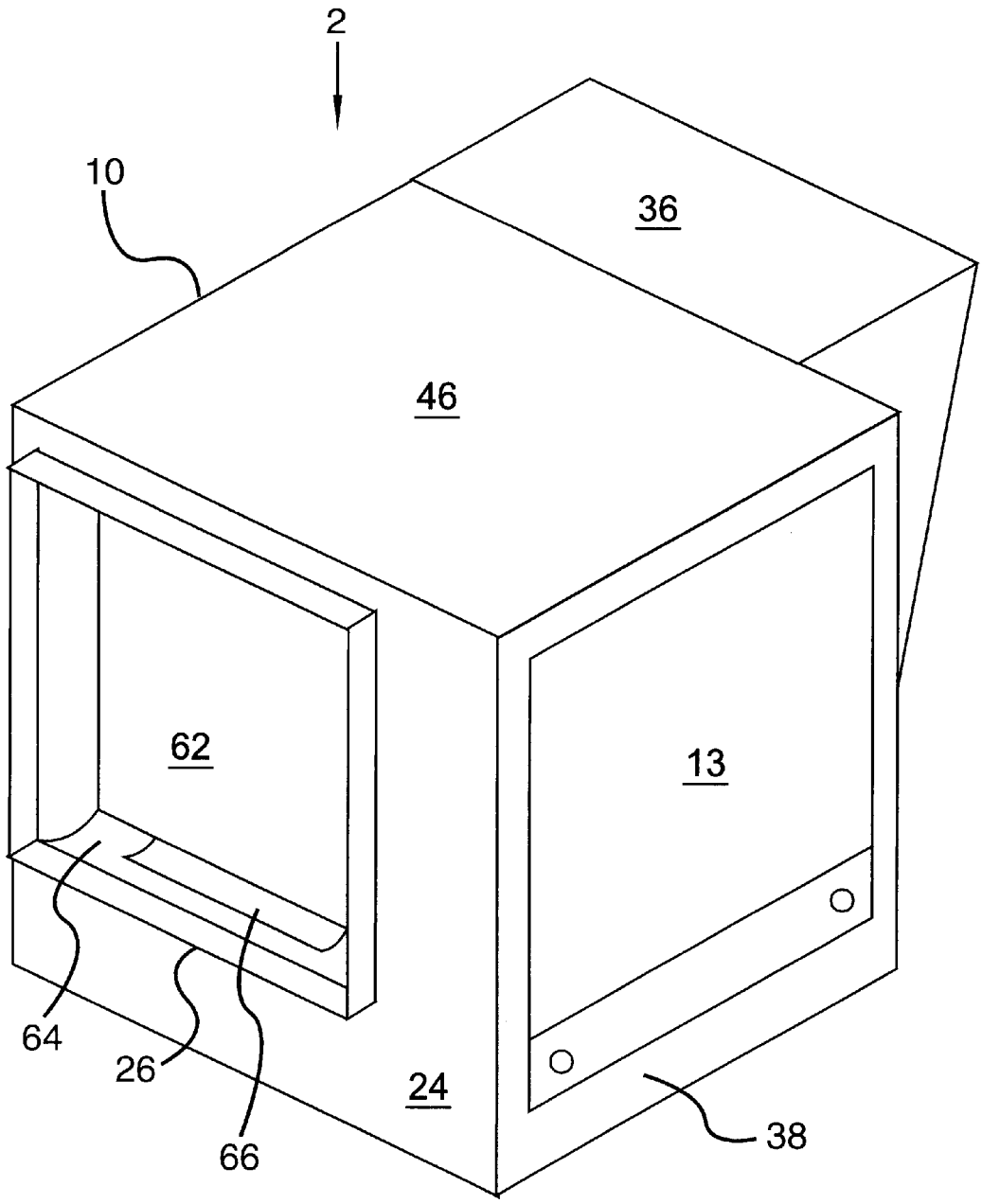
FIG. 1 is a three dimensional perspective view of the preferred demand ventilation module of the invention.
Figure 3:
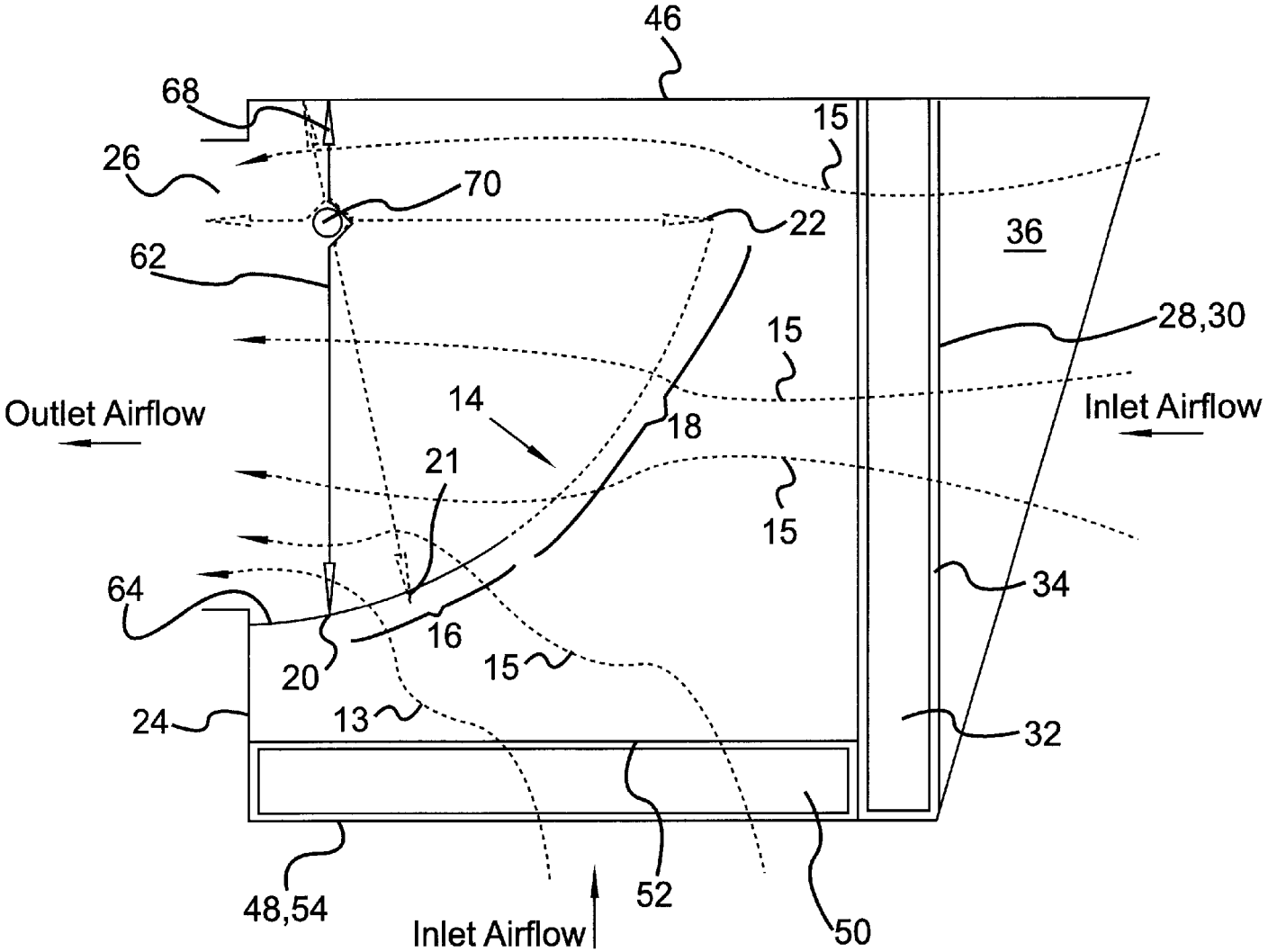
FIG. 3 is a partially broken away cross sectional side view depicting airflow through the inner chamber of the preferred demand ventilation module depicted in FIG. 1.

As specifically depicted in FIGS. 1 and 3, damper 62 can smoothly shift to any number of positions along damper stroke range 14. At minimum air flow position 20, air is completely restricted by damper 62 and restrictor plate 64. At position 21, a portion of air-restricting opening 66 is exposed, thereby allowing air flow 13 for example to pass up through opening 66. At maximum air flow position 22, damper 62 is fully open and air flows 15 can pass through demand ventilation module 2 freely. Therefore, the more damper 62 opens along damper stroke range 14 and shifts out of stage 16, wherein air restrictor plate 64 is located, the higher the volume of outside air passes through outlet 26 of demand ventilation module 2 and into HVAC system 100.

Thus, demand ventilation module 2 with preferred air restrictor plate 64 can act as a two-stage damper assembly whereby first stage 16 restricts the airflow to achieve better control under low velocity conditions and second stage 18 allows the air to bypass restrictor plate 64 when maximum velocity is desired. Specifically, air-restricting opening 66 controls outside air flow and requires damper 62 to move further to allow the same volume of air to pass through module 2 than would otherwise be necessary. This longer stroke results in more accurate control of damper 62 under low air velocity conditions, and gives demand ventilation module 2 airflow characteristics of a smaller damper assembly when ventilating, thereby keeping the flow curve much more non-linear throughout its range. For example, air flow curves of demand ventilation module 2, when return air negative static pressure is between the range of approximately −0.2" to −0.6" negative pressure, provide a "flattened" curve in the 0–450 cfm range as damper 62 rotates on its axis along at least one air restrictor plate 64. This non-linear flow curve provided by demand ventilation module 2 provides better controllability when controlling very low volumes of air during ventilation operation and higher volumes of air during economizing operation.

Figure 6:
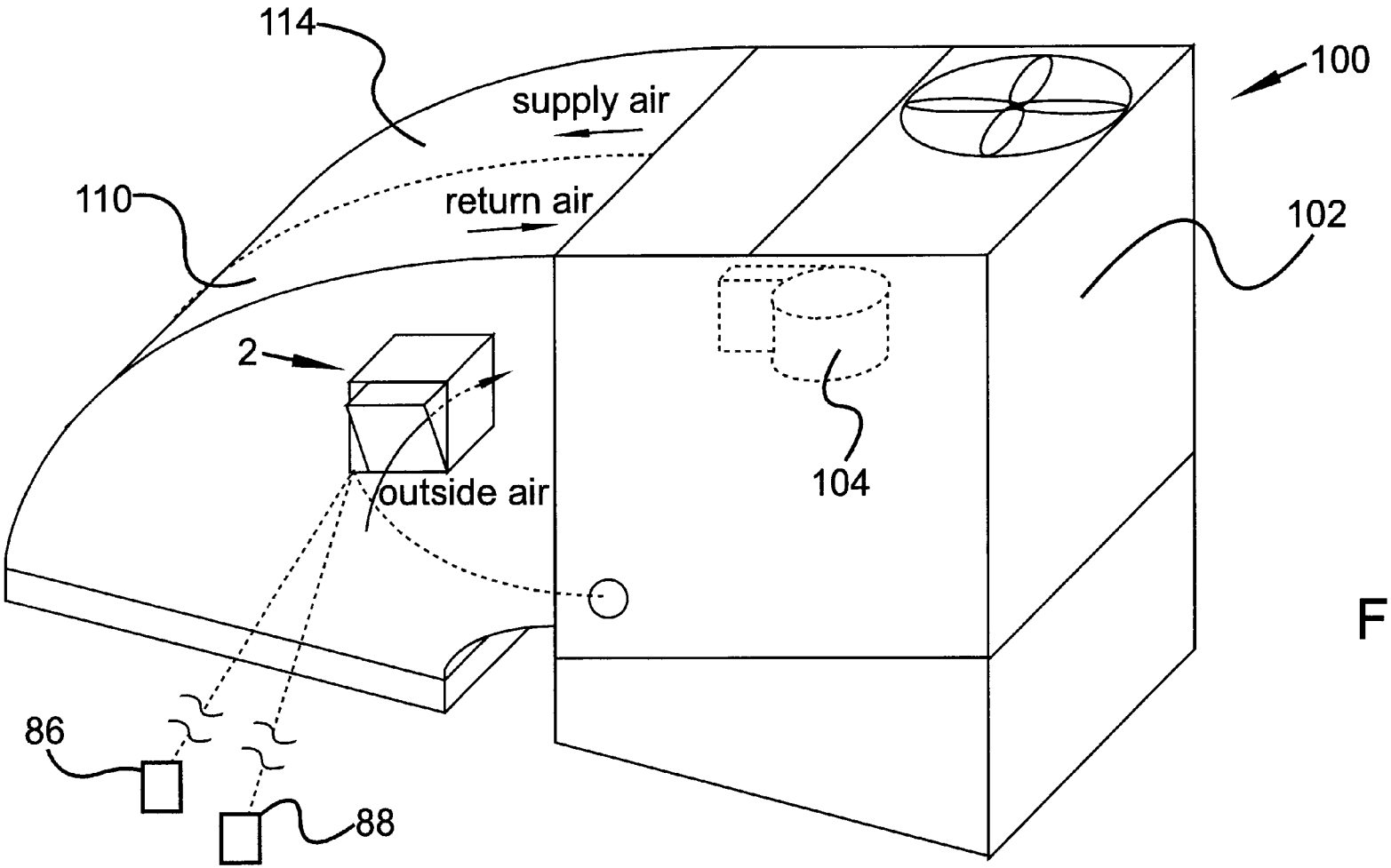
FIG. 6 is a three dimensional perspective view of a typical installation of the preferred demand ventilation module depicted in FIG. 1. in an outside HVAC application.
Figure 7:
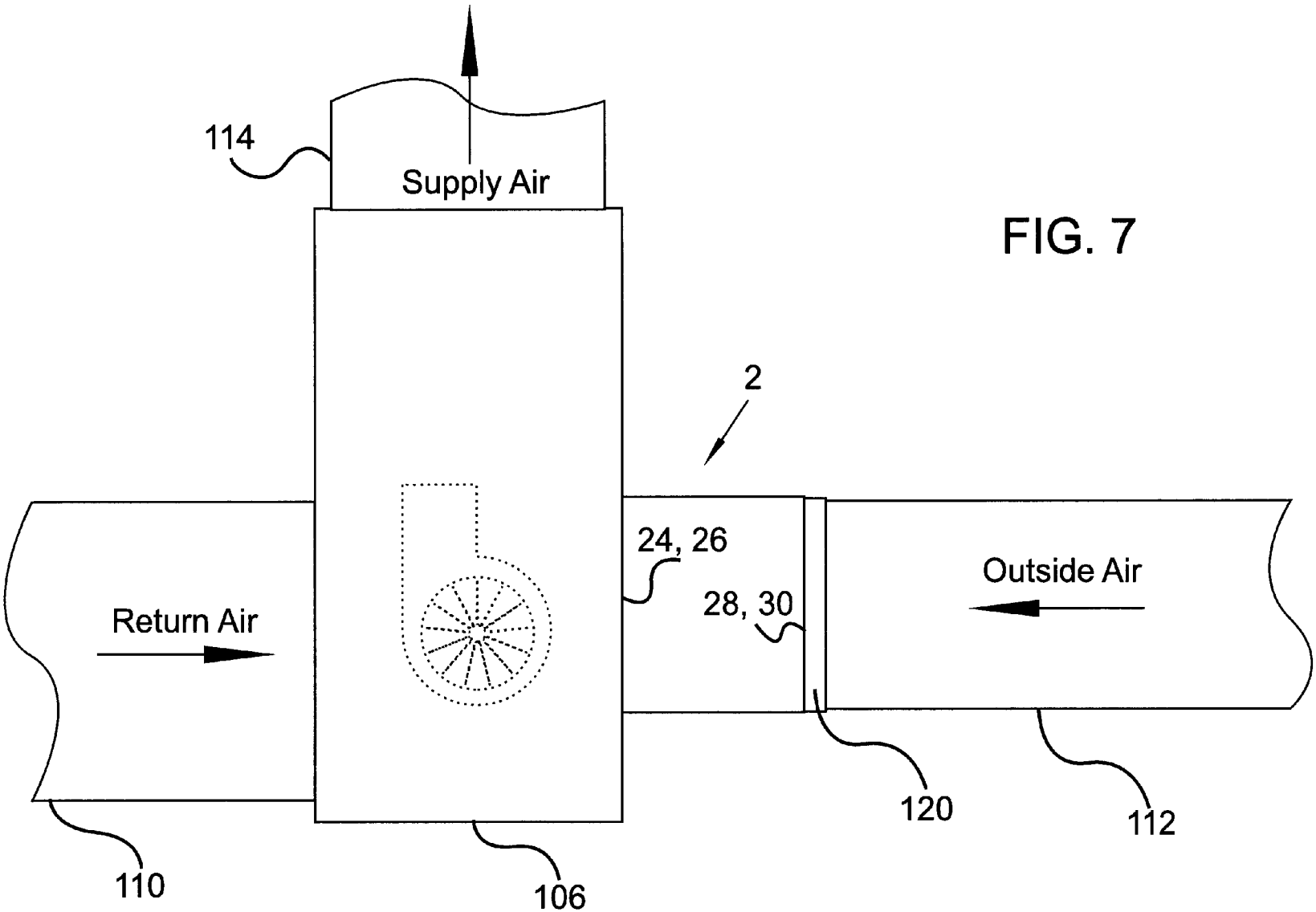
FIG. 7 is a side view of a typical installation of the preferred demand ventilation module depicted in FIG. 1. in an inside HVAC application.

Referring generally to FIGS. 1–7 again, demand ventilation module 2 also preferably includes a housing 10 that defines an inner chamber 12 wherein damper assembly 60 is located. If included, damper seal 68 preferably seals against inner chamber. Demand ventilation module 2's universal retrofitting capability can compensate for the countless variances in building designs, HVAC system designs, and the like. Housing 10 is easily adaptable to be coupled to any location on a return portion of HVAC system 100. Thus, housing 10 is adaptable to be coupled to a return portion of HVAC unit 102 or a return duct 110 of HVAC system 100 for an outside application as depicted in FIG. 6 and hereinafter described, as well as adaptable to be coupled to a return portion of inside air handler 106, an outside air duct 112, or a return duct 110 of HVAC system 100 for an indoor application as depicted in FIG. 7 and hereinafter described. Housing 10 can be any size or the like depending on the ventilation application, size of damper assembly 60, or the like. Housing 10 includes an air outlet 26 and at least one outside air inlet. Preferably, at least one outside air filter is used in conjunction with the at least one outside air inlet. More preferably, housing 10 further includes a front wall 24, a rear wall 28, a right wall 38, a left wall 40, a top wall 46, and a bottom wall 48. Thus, housing 10 can lend itself to being cuboidal in configuration. However, housing 10 can be any three-dimensional configuration, such as rectangular cuboidal, tubular, and the like.

Preferred front wall 24 is adaptable to be coupled to the return portion of HVAC unit 102 or return duct 110 of HVAC system 100 as depicted in FIG. 6 and hereinafter described. Alternatively, front wall 24 is also adaptable to be coupled to the return portion of inside air handler 106, outside air duct 112, or return duct 110 of HVAC system 100 for an indoor application as well as depicted in FIG. 7 and hereinafter described. Air outlet 26 is preferably located through front wall 24. Nevertheless, outlet 26 can be located at any suitable place on housing 10 and can be any size, configuration, or the like suitable for allowing air to exit module 2 and enter HVAC system 100. Coupled to front wall 24 and/or air outlet 26 can be preferred restrictor plate 64. Restrictor plate 64 protrudes from front wall 24 into inner chamber 12 along first stage 16 of damper stroke range 14.

Preferred rear wall 28 preferably includes a vertical outside air inlet 30 in conjunction with a vertical outside air filter 32. Air inlet 30 is preferably located through rear wall 28. Vertical filter 32 is preferably positioned inside of vertical guide track 34, which encompass the interior perimeter of rear wall 28. Notwithstanding, inlet 28 and corresponding filter 32 can be located at any suitable place on housing 10 and can be any size, configuration, or the like suitable for regulating air entering module 2. An inlet hood 36 coupled to rear wall 28 is further preferably provided if housing 10 is to be coupled to the return portion of HVAC unit 102 or return duct 110 of HVAC system 100 for an outside application as depicted in FIG. 6. Inlet hood 36 protrudes out from rear wall 28. Inlet hood 36 is suitable for sheltering an air inlet and can be any size, configuration, or the like, can be louvered, and can be located at any suitable place on housing 10. Alternatively, if housing 10 is to be coupled to the return portion of inside air handler 106, outside air duct 112, or return duct 110 of HVAC system 100 for an indoor application as depicted in FIG. 7, then inlet hood 36 is replaced by a duct collar 120 in order to couple rear wall 28 to outside air duct 112. Collar 120 can be any size, configuration, such as rectangular or round, or the like depending on demand ventilation module 2 and outside air ducting 112. Furthermore, vertical filter 32 and vertical guide track 34 may or may not be necessary depending on whether or not outside air filtration was incorporated into existing building design. If module 2 is located in-line with outside air duct 112, front wall 24 and air outlet 26 are coupled to a downstream side of outside air duct 112 instead of to the return portion of air handler 106 or return air duct 110.

Preferred right and left walls 38 and 40 respectively are preferably suitable to support damper assembly 60. Right wall 38 preferably includes bushing 72 therethrough at a suitable location in relation to damper assembly 60 adaptable to receive an end of damper shaft 70. Left wall 40 also preferably includes bushing 72 therethrough at a suitable location in relation to damper assembly 60 adaptable to receive an end of damper shaft 70. Bushings 72 in walls 38 and 40 are adaptable to receive and retain the ends of damper shaft 72. The respective ends of damper shaft 70 can extend through bushings 72, and preferably, one end of damper shaft 70 protrudes beyond bushing 72 and is coupled to an actuator motor 80 as hereinafter described. If included, damper seal 68 preferably seals against right wall 38, left wall 40, top wall 46, and restrictor plate 64 to improve controllability of air flow through first stage 16 and a second stage 18 of damper stroke range 14. Notwithstanding, damper assembly 60 can be located at any suitable place on housing 10 in like fashion.

Preferred bottom wall 48 preferably includes a horizontal outside air inlet 54 in conjunction with a horizontal outside air filter 50. Air inlet 54 is preferably located through bottom wall 48. Horizontal filter 50 is preferably positioned inside of horizontal guide track 52, which encompass the interior perimeter of bottom wall 48. Notwithstanding, inlet 54 and corresponding filter 50 can be located at any suitable place on housing 10 and can be any size, configuration, or the like suitable for regulating air entering module 2. If housing 10 is to be coupled to the return portion of inside air handler 106, outside air duct 112, or return air duct 110 of HVAC system 100 for an indoor application as depicted in FIG. 7, then inlet 54, filter 50, and guide track 52 are eliminated from demand ventilation module 2.

Figure 2:
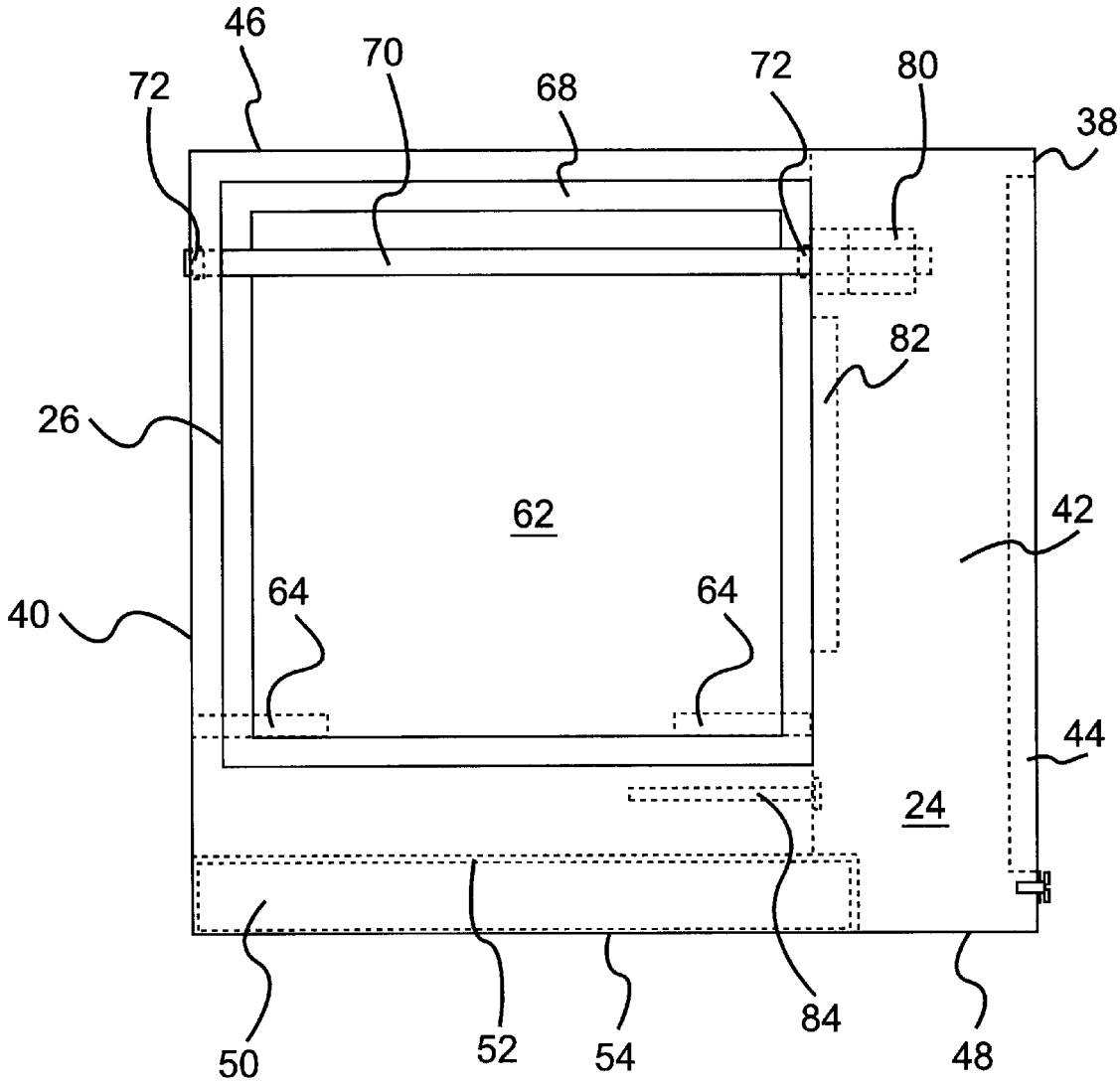
FIG. 2 is a front view of the preferred demand ventilation module depicted in FIG. 1.
Figure 4:
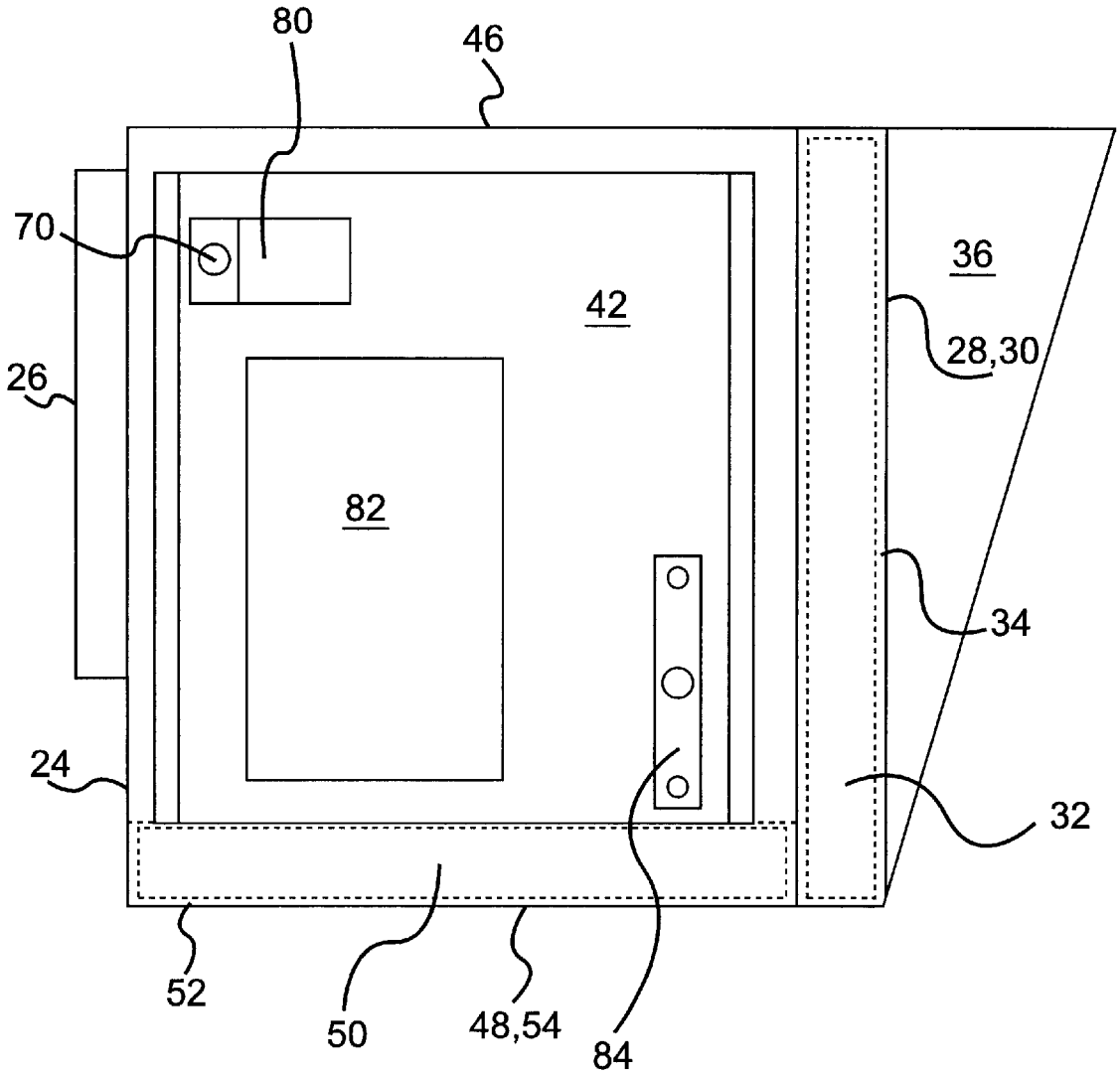
FIG. 4 is a side view of the preferred demand ventilation module depicted in FIG. 1, wherein the control cabinet cover is removed and the underlying control cabinet is exposed.

Referring to FIGS. 2, 4, and 6, demand ventilation module 2 also preferably includes an actuator 80, at least one outside air sensor 84, at least one inside air sensor 86, and an electronic control device 82. Preferably, actuator 80, at least one outside air sensor 84, and electronic control device 82 are self-contained and integrated into previously described housing 10. A control cabinet cover 44 and a corresponding underlying control cabinet 42 can be located at any location in or on housing 10. Control cabinet 42 and cover 44 preferably form a portion of either right wall 38 or the left wall 40, but could form a portion of any suitable place on housing 10 and can be any size, configuration, or the like. As depicted in FIGS. 2 and 4, control cabinet 42 preferably houses electronic control device 82, actuator 80, and at least one outside air sensor 84. Actuator 80 is mounted in a suitable location in relation to damper assembly 60. Preferably, the end of damper shaft 70 that extends beyond bushing 72 is coupled to actuator motor 80. At least one outside air sensor 84 is preferably mounted through cabinet 42 so as to protrude into inner chamber 12 and to be near either inlet 30 or inlet 54, thereby capable of sensing outside air conditions. Notwithstanding, the layout of electronic control device 82, actuator 80, and at least one outside air sensor 84 within cabinet 42 could change based on dimensions of the individual controls selected, orientation of damper assembly 60, and the like without effecting function.

Actuator 80 can be any modulating device that responds to variable input signals in order to facilitate a mechanical motion. For example, actuator 80 could be two-position, tri-state, floating or proportional depending upon the application. Preferably, actuator 80 is a Belimo #LM24-SR US. Actuator 80 automatically shifts damper 62, upon receiving an appropriate stimulus, to any position in damper stroke range 14 between minimum airflow position 20 and maximum airflow position 22 and in direct proportion to actual real-time air condition demand.

At least one outside air sensor 84 is capable of measuring outside air conditions and for transmitting respective stimulus dependent thereon. At least one inside air sensor 86 is capable of measuring inside air conditions and for transmitting respective stimulus dependent thereon. Inside air sensor 86 can be field wired and mounted inside return air duct 110, in the inside space itself, or any other suitable location where inside space air conditions can be accurately sensed. For example, inside air sensor 86 can be located inside control cabinet 42 if equipped with remote sensing probe(s) routed to the appropriate location(s) where inside space air conditions can be accurately sensed. At least one inside air sensor 86 can also include a dual contaminant and temperature sensor. The contaminant sensor element of the dual inside sensor is preferably a $CO_2$ sensor, $CO_2$ levels being indicative of occupancy of the inside space. Alternatively, as depicted in FIG. 6, in addition to inside air sensor 86 a distinct contaminant sensor 88 can also be provided. Inside and outside air conditions capable of being measured by at least one outside air sensor 84 and at least one inside air sensor 86 and utilized by demand ventilation module 2 include for example, but are not limited to: temperature; humidity; relative humidity; enthalpy; moisture content; contaminants, such as carbon dioxide ($CO_2$), carbon monoxide, volatile organic compounds, smoke or dust particulates, and other organic and inorganic gases; or any combination thereof.

Electronic control device 82 can be any electronic circuit board with binary and/or analog inputs and binary and/or analog outputs, and capable of receiving input information and controlling output variables. Electronic control device 82 preferably is a computer having universal software programming for setting and storing pre-set minimum absolute air condition differential parameters (air condition set-points) for ventilation activation, and for controlling all other demand ventilation module 2 functions and HVAC system 100 control functions, such as at least HVAC fan 104 control function. More preferably, electronic control device 82 is a direct digital control (DDC) microprocessor, such as the Wattmaster TUC 5Rplus for example. Electronic control device 82 is electrically connected to actuator 80 for controlling the activation thereof. Electronic control device 82 is also electrically connected to both outside sensor 84 and inside sensor 86 for controlling the activation thereof and receiving stimulus therefrom.

Preferably, electronic control device 82 uses a single sensor differential method for ventilation activation. Electronic control device 82 preferably controls a pre-purge cycle of the inside space and is pre-programmed with pre-purge time start and duration intervals in proportion to inside space volume. Just prior to the end of the pre-purge cycle, the air condition set-point is "set". Thus, electronic control device 82 can activate HVAC fan 104 and actuator 80 to cause the transport of outside air into the inside space, thereby allowing the inside air conditions to be equilibrated with the outside air conditions. Just prior to the end of the pre-purge cycle (when inside space and outside air conditions are at equilibrium), electronic control device 82 can cause at least one inside sensor 86 to sense the inside equilibrated air conditions and to transmit to electronic control device 82 air condition stimulus dependent thereon, wherein electronic control device 82 sets and stores the at least one air condition set-point for ventilation activation. Then, after the end of the pre-purge cycle, electronic control device 82 can cause at least one inside sensor 86 to sense the inside air conditions and to transmit to electronic control device 82 respective air condition stimulus dependent thereon. Upon receiving the stimulus, electronic control device 82 can compare the at least one air condition set-point for ventilation activation to an applicable sensed inside air condition. If the sensed inside air condition is greater than the at least one air condition set-point, electronic control device 82 activates actuator 80 to cause the transport of outside air into the inside space, thereby diluting inside air conditions and maintaining the inside space at the at least one air condition set-point.

As an example of the single sensor differential method for real-time air condition demand ventilation and/or economizing operation, electronic control device 82 can activate HVAC fan 104 and actuator 80 to cause the transport of outside air into the inside space, thereby allowing the inside air conditions to be equilibrated with the outside air conditions. Just prior to the end of the pre-purge cycle, electronic control device 82 can cause at least one inside sensor 86 to sense the equilibrated contaminant level (e.g., $CO_2$ level) and/or the equilibrated temperature of inside space air and to transmit to electronic control device 82 contaminant level (e.g., $CO_2$ level) stimulus and/or temperature stimulus dependent thereon, wherein electronic control device 82 sets and stores the at least one contaminant (e.g., $CO_2$ level) level set-point and/or the temperature set-point for ventilation activation. Then, electronic control device 82 can cause at least one inside sensor 86 to sense the inside contaminant level (e.g., $CO_2$ level) and/or the inside temperature and to transmit to electronic control device 82 contaminant level (e.g., $CO_2$ level) and/or temperature stimulus dependent thereon. Upon receiving the stimulus, electronic control device 82 can compare the sensed inside contaminant level (e.g., $CO_2$ level) and/or the sensed inside temperature to the at least one contaminant level (e.g., $CO_2$ level) set-point and/or the temperature set-point for ventilation activation. If the sensed contaminant level (e.g., $CO_2$ level) and/or the sensed temperature is greater than the at least one contaminant level (e.g., $CO_2$ level) set-point and/or the temperature set-point, electronic control device 82 activates actuator 80 to cause the transport of outside air into the inside space, thereby diluting inside air conditions and maintaining the inside space at the at least one contaminant level (e.g., $CO_2$ level) set-point and/or the temperature set-point.

Alternatively, as electronic control device 82 can be pre-programmed and is capable of setting and storing air condition set-points for ventilation activation, electronic control device 82 can also use a dual sensor differential method for ventilation activation. Electronic control device 82 can determine the respective absolute air conditions of the inside space air and of the outside air and the absolute air condition differentials between the respective absolute air conditions, and compare the differentials to the air condition set-points for ventilation activation. Thus, electronic control device 82 can cause at least one outside sensor 84 and at least one inside sensor 86 to sense the respective inside air conditions and outside air conditions and to transmit to electronic control device 82 respective air condition stimulus dependent thereon. Upon receiving the stimulus, electronic control device 82 can determine the absolute air condition differential between the respective sensed air conditions and can compare the differential to the air condition set-point for ventilation activation. If the air condition differential is greater than the air condition set-point, electronic control device 82 can activate actuator 80 to cause the transport of outside air into the inside space so as to dilute inside air conditions and maintain the inside space at the air condition set-point.

As an example of the dual sensor differential method for real-time air condition demand ventilation and/or economizing operation, electronic control device 82 can cause at least one outside sensor 84 and at least one inside sensor 86 to sense respective contaminant levels (e.g., $CO_2$ level) and/or temperatures of inside space air and of outside space air and to transmit to electronic control device 82 respective contaminant level stimulus (e.g., $CO_2$ level) and/or temperature stimulus dependent thereon. Upon receiving the stimulus, electronic control device 82 can determine the absolute contaminant level (e.g., $CO_2$ level) differential between the respective absolute contaminant levels (e.g., $CO_2$ levels) and compares the differential to the absolute contaminant level (e.g., $CO_2$ level) set-point for ventilation activation, and/or electronic control device 82 determines the absolute temperature differential between the respective absolute temperatures and compares the differential to the absolute temperature set-point for ventilation activation. If the contaminant level (e.g., $CO_2$ level) differential is greater than the contaminant level (e.g., $CO_2$ level) set-point, electronic control device 82 activates actuator 80 to cause the transport of outside air into the inside space, thereby diluting inside air conditions and maintaining the inside space at the contaminant level (e.g., $CO_2$ level) set-point, and/or if the temperature differential is greater than the temperature set-point, electronic control device 82 activates actuator 80 to cause the transport of outside air into the inside space, thereby diluting inside air conditions and maintaining the inside space at the temperature set-point.

Components of demand ventilation module 2 may be made from any of many different types of materials. Preferably, though, damper assembly 60, excluding damper shaft 70 and damper seal 68, and housing 10, including cabinet 42 and cover 44 but excluding filters 32 and 50, are made out of sheet metal. Nevertheless, damper assembly 60 and housing 10 might be made from other materials suitable for ventilation applications. Damper shaft 70 preferably is a metal rod, preferably nickel-plated steel. Damper seal 68 preferably is a conforming elastic material, such as a closed cell foam seal. Filters 32 and 50, actuator 80, electronic control device 82, outside sensor 84, and inside sensor 86 are all well known in the art and can be purchased premanufactured and then modified if desired.

Describing the installation and use of demand ventilation module 2 further, the preferred method of installing demand ventilation module 2 is to couple demand ventilation module 2 to a return portion of HVAC system 100, whereby demand ventilation module 2 can draw and regulate outside air into HVAC system 100 and into the inside space of a structure by way of an air pressure differential between return air and outside air in direct proportion to actual real-time air condition demand. Before beginning the actual installation of demand ventilation module 2, the return portion of HVAC system 100 is evaluated to ascertain return air negative static pressure. Then it is determined where to install demand ventilation module 2 on the return portion of HVAC system 100 based upon a location corresponding with a preferred range of return air negative static pressure, the preferred range of static pressure being preferably approximately −0.05" to −1.0" negative pressure. Other factors in determining where to install demand ventilation module 2 on the return portion of HVAC system 100 can be physical limitations on HVAC system 100, the structure, or the like, as well as pollutant sources, such as sewer vents, exhaust fans, loading docks, or the like, located nearby or adjacent to HVAC system 100 that would make inside air quality worse if taken in by demand ventilation module 2. Demand ventilation module 2 is then installed at the predetermined location on the return portion of HVAC system 100. Furthermore, at least one balancing damper can be located in the return portion of HVAC system 100 for increasing the return air negative static pressure if the static pressure ascertained is below the preferred range of approximately −0.05" to −1.0" negative pressure. Moreover, demand ventilation module 2 can further be installed so as to control HVAC system 100 control functions. Specifically, at least one HVAC system 100 control function can be selected. The at least one HVAC system 100 control function can then be overridden with electronic control device 82 to provide electronic control device 82 with control over the at least one HVAC system 100 control function. The at least one HVAC system 100 control function can then be enabled to interface with purging, ventilating, and/or economizing functions of demand ventilation module 2.

Specifically in FIG. 6, demand ventilation module 2 is depicted installed with HVAC system 100 in an outside application. Demand ventilation module 2 can be installed at any location on return air duct 110 or a return portion of HVAC unit 102 of HVAC system 100, whereby demand ventilation module 2 can draw and regulate outside air into HVAC system 100 and into the inside space of a structure by way of an air pressure differential between return air and outside air in direct proportion to actual real-time air condition demand. Preferably demand ventilation module 2 is located as close to HVAC unit 102 as possible between the return air filter and the cooling coil. As before, return air duct 110 and the return portion of HVAC unit 102 of HVAC system 100 is evaluated to ascertain return air negative static pressure. Then it is determined where to install demand ventilation module 2 on return air duct 110 or the return portion of HVAC unit 102 of HVAC system 100 and if an adjustment to negative static pressure, i.e. installation of a balancing damper, is necessary.

Demand ventilation module 2 is then installed at the predetermined location on return air duct 110 or the return portion of HVAC unit 102 of HVAC system 100. As depicted in FIG. 6, preferably an opening is cut in return air duct 110 of HVAC system 100. Outlet 26 is then preferably fitted over and/or into the opening and demand ventilation module 2 is then secured to return air duct 110 with screws or other fasteners. Caulking or another suitable sealant is also preferably applied to provide an air and watertight connection. Preferably, at least one inside air sensor 86 is mounted in the inside space, return air duct 110, housing 10, or HVAC unit 102 as previously described. Location of these sensors may vary depending upon building architecture and HVAC system 100 design and application. Actuator 80 and electronic control device 82 are then preferably wired as is known in the art, with power supply preferably being supplied from the existing transformer of HVAC unit 102 and without the use of high voltage as required with other ventilation products. Actuator 80 and electronic control device 82 require only low voltage and consume only a few watts of energy when operating. After wiring is completed, power is applied to the circuit. Preferably, all operating parameters are pre-programmed with default settings to allow simple configuration and operation. Adjustments to set-points are made through various interface tool options i.e., computer, hand-held or wall-mounted electronic interface, or the like.

Alternatively and specifically referring to FIG. 7, demand ventilation module 2 is depicted in conjunction with air handler 106 of HVAC system 100 in an inside application. Demand ventilation module 2 can be installed on return air duct 110, a return portion of inside air handler 106, or outside air duct 112 of HVAC system 100, whereby demand ventilation module 2 can draw and regulate outside air into HVAC system 100 and into the inside space of a structure by way of an air pressure differential between return air and outside air in direct proportion to actual real-time air condition demand. As before, return air duct 110, a return portion of inside air handler 106, or outside air duct 112 of HVAC system 100 is evaluated to ascertain return air negative static pressure. Then it is determined where to install demand ventilation module 2 on return air duct 110, a return portion of inside air handler 106, or outside air duct 112 of HVAC system 100. Demand ventilation module 2 is then installed at the predetermined location on return air duct 110, a return portion of inside air handler 106, or outside air duct 112 of HVAC system 100. Preferably, as shown in FIG. 7, an opening is cut in air handler 106. Demand ventilation module 2 is then preferably installed as previously described in relation to FIG. 6, but also with the preferred coupling of demand ventilation module 2 to outside air duct 112 with collar 120 as described previously.

At this point, whether installed in conjunction with an outside application or an inside application, demand ventilation module 2 is set to perform its four preferable functions or modes: pre-purge cycle, ventilation mode, economizer mode, and HVAC unit control. Some of these modes have generally been described previously, but are described by example in more detail below in reference to FIGS. 1–7 by focusing primarily on ventilation activation in direct proportion to actual real time contaminant level and temperature demand. Thus, the following discussion of the preferred modes is illustrative only, and as described previously, demand ventilation module 2 can be used in conjunction with virtually any combination of air conditions for ventilation activation in direct proportion to actual real time demand.

Pre-Purge Cycle

When buildings are shut down during periods of unoccupancy, indoor air conditions and pollutants tend to accumulate due to lack of ventilation and air filtration. These contaminant sources include for example, but are not limited to, off gassing of synthetic products such as building materials and furniture, molds, chemicals, and pesticides. A preferred method of controlling inside air pollutants is to compare them to levels of the same pollutant encountered outside. This difference is referred to as a "differential". The differential can be generated by using one sensor to monitor outside levels and compare the readings to another sensor monitoring inside levels. Two problems can arise with this dual sensor differential method. First, the two sensor calibrations can vary. Even if they are the same when new, they can drift somewhat as time goes on, causing an erroneous differential reading. Secondly, the use of two sensors drives cost up.

Therefore, demand ventilation module 2 more preferably uses a single sensor differential method whereby the outdoor contaminant level is "set" just prior to the end of the pre-purge cycle, preferably one minute prior for example. At this point in time the building has been purged and the inside and outside contaminant levels have reached equilibrium. Now when electronic control device 82 reverts to normal ventilation mode, it merely controls damper 62 to maintain the set contaminant level set-point. This single sensor differential method automatically compensates for sensor calibration drift, return air and outside air filter loading, return and/or supply duct leakage, undersized or restricted ducting, dirty refrigerant coils, as well as variations in outdoor contaminant levels that may vary due to location. For example, carbon monoxide and carbon dioxide levels will be higher outdoors near a freeway as opposed to a rural area. Furthermore, the set-point is always accurate and calibrated. Thus, the pre-purge cycle can serve two important functions: (a) it can purge accumulated contaminants from the building prior to occupancy and (b) it can mark a baseline or "set-point" from which electronic control device 82 can regulate inside contaminant levels as compared to outside levels.

Since room volumes vary widely, the building operator, via time start and duration set-points on the software associated with electronic control device 82, can determine the duration of the purge cycle. When the pre-purge cycle is activated, HVAC fan 104 is forced on and demand damper 62 of ventilation module 2 is modulated to maximum air flow position 22. This action allows indoor contaminant levels to be diluted to outdoor air conditions. After the pre-purge time is satisfied, electronic control device 82 reverts to normal operation and ventilation mode.

Ventilation Mode

Under the preferred single sensor differential method for ventilation activation, air borne molecules in the air stream pass by at least one inside air sensor 86 either by means of forced air or natural diffusion in the room depending on sensor location. At least one inside air sensor 86 senses inside air condition changes and initiates a corresponding electronic signal or stimulus to electronic control device 82 and electronic control device 82 interprets the signal. Electronic control device 82 will then initiate continuous HVAC fan 104 operation: (a) if time schedules in the software associated with electronic control device 82 call for HVAC unit 102 to run in the occupied mode or (b) when contaminant levels reach the previously marked set-point from the pre-purge cycle. This guarantees HVAC fan 104 operation anytime ventilation is required.

If the contaminant levels reach set-point, electronic control device 82 starts HVAC fan 104 and sends a corresponding electronic signal or stimulus to actuator 80 causing actuator 80 to automatically begin rotating damper 62 open in proportion to the change in contaminant levels. As damper 62 opens, outside air is drawn through demand ventilation module 2 into HVAC system 100 through an air pressure differential. That is, since the return air pressure (below 0 in. w.g.) is lower than outside air pressure, outside air will flow into demand ventilation module 2 and into HVAC system 100 when damper 62 is open.

As ventilation demand increases, damper 62 modulates toward maximum air flow position 22, increasing airflow so the amount of outside air intake is increased to meet ventilation demand. When ventilation demand decreases, damper 62 modulates toward minimum air flow position 20, reducing airflow so the amount of outside air intake is minimized to meet decreased ventilation demand.

Economizer Mode

Under the preferred dual sensor differential method for economizing ventilation activation, electronic control device 82 receives temperature input signals from inside sensor 86 and outside sensor 84. Electronic control device 82 compares outside air temperature to inside air temperature. If outside air temperature contains less sensible and/or latent heat than inside air, and the inside space temperature set-point calls for cooling, electronic control device 82 sends a corresponding electronic signal to actuator motor 80. Actuator 80 responds to the signal and rotates, causing damper 62 to modulate open. When damper 62 moves beyond restrictor plate 64, a larger volume of air is allowed to pass through demand ventilation module 2 providing maximum cooling benefits. As the inside space temperature cools toward desired set-point, damper 62 will modulate back to deliver less cool air.

Thus, electronic control device 82 will modulate damper 62 open or closed providing adequate cooling to satisfy room temperature. Damper 62 stays open until differential temperature between inside air and outside air fall outside economizer operating parameters or cooling demand is satisfied, whereupon damper 62 closes and electronic control device 82 then reverts back to ventilation mode. If economizer operation alone is not enough, then mechanical cooling is initiated as well. The controller receives inputs from inside sensor 86 and a supply air sensor (not shown) and initiates mechanical cooling by sending output signals to HVAC unit 102.

HVAC Unit Control

Many electronic control devices 82, especially DDC microprocessors, are capable of providing automated benefits such as: switching between heating and cooling modes automatically; providing limitation of inside space temperature set-points to reduce abuse of energy and equipment; providing automatic setback temperature set-points during unoccupied hours for energy conservation; providing holiday and weekend scheduling in order to setback inside space temperatures or turn HVAC equipment off during unoccupied days; and generating alarms that notify building operators of conditions outside desired parameters.

Unlike other ventilation strategies and products, demand ventilation module 2 preferably incorporates control over the HVAC functions. Demand ventilation module 2 preferably incorporates pre-engineered "two-stage" damper assembly 60, electronic control device 82 with programming, outside and inside sensors 84 and 86, and actuator 62 into housing 10 designed to universally retrofit existing HVAC equipment. This combines the benefits of electronic HVAC control and ventilating and economizing functions in one pre-programmed add-on module. Moreover, in demand ventilation module 2's approach to ventilation, demand ventilation module 2 controls HVAC unit functions and operations instead of visa versa, or at least controls HVAC fan 104. Therefore, several important HVAC control features will be described in conjunction with demand ventilation module 2.

Demand ventilation module 2, unlike other ventilation strategies and products, is fully capable of trend logging. The user selects how often, in minutes or hours, preferred DDC microprocessor 82 should take a "snapshot" of the input values. DDC microprocessor 82 then records input data such as inside space temperature, outside air temperature and contaminant levels for troubleshooting and documentation. The trend logging feature allows intermittent problems with temperature, ventilation, or mechanical shutdowns to be identified more quickly. In addition, the record or trend log can be used as documentation in case of occupant complaint or litigation.

Because demand ventilation module 2 preferably uses DDC microprocessor 82, demand ventilation module 2 is fully capable of generating alarms. If any of the operating parameters, such as temperature, humidity, or contaminant levels, reach a user-defined alarm limit, a signal is dispatched. This signal could be an alphanumeric message sent to a facility person with an "emergency pager" via modem, a computer print out, an alarm message displayed on a computer monitor, or an alarm bell.

Accordingly, this invention overcomes the drawbacks of previous ventilation strategies and products by preferably providing a self-contained, filtered outside air module with an integrated, "two-stage" damper assembly and demand ventilation controls and sensors. The demand ventilation module of this invention can be used to easily retrofit a wide variety of HVAC systems, without roof penetrations, mounting stands, or line voltage supply, in order to provide an accurate ventilation means. Furthermore, the demand ventilation module of this invention further automates the HVAC system enabling a controlled pre-purge cycle, ventilation mode, economizer mode, and total HVAC unit control. Moreover, the demand ventilation module of this invention reduces installation costs and requires minimal maintenance and repair. In addition, the demand ventilation module of this invention saves energy and prevents HVAC equipment abuse by providing only the minimum amount of ventilation necessary for the condition, by providing outside air economizing when ambient conditions are favorable, and by providing controls and sensors capable of making adjustments automatically when conditions change.

While the invention has been particularly shown and described with reference to a preferred embodiment thereof, together with numerous characteristics and advantages of the invention, details of the structure and function of the invention, and examples set forth herein to best explain the present invention and its practical application and to thereby enable those skilled in the art to make and use the invention, it will be understood by those skilled in the art that various changes in form and details, and especially in the matters of shape, size and arrangement of parts, may be made therein to the full extent indicated by the broad general meaning of the terms in which the appended claims are expressed, and without departing from the spirit and scope of the invention, and that the foregoing description and examples have been presented for the purposes of illustration and example only and is not intended to be exhaustive or to limit the invention to the precise form disclosed. Similarly, unless otherwise specified, any sequence of steps of the method indicated herein are given as an example of a possible sequence and not as a limitation.

What is claimed is:

1. An apparatus for ventilating inside space of a structure comprising:

a demand ventilation module for use with a heating, ventilation, and air conditioning (HVAC) system comprising:

a housing adaptable to be coupled to a return portion of the HVAC system, the housing defining an inner chamber and comprising an air outlet and at least one outside air inlet;

an integrated damper located in the inner chamber for regulating outside air infiltration into the HVAC system and into the inside space by way of an air pressure differential between return air and the outside air in direct proportion to actual real-time air condition demand;

at least one restrictor plate in conjunction with the air outlet protruding into the inner chamber, the at least one air restrictor plate defining an air-restricting opening along a first stage of a damper stroke range, the air-restricting opening controlling outside air flow and requiring the damper to move further to allow the same volume of air to enter the HVAC system than would otherwise be necessary, thereby resulting in more accurate control of the damper under low air velocity conditions; and a damper seal along an outside perimeter of the damper that seals against the inner chamber and the at least one restrictor plate, thereby improving controllability of air flow through the first stage and a second stage of the damper stroke range.

2. The apparatus of claim 1 further comprising:

an actuator for automatically shifting the damper, upon receiving an appropriate stimulus, to any position in a damper stroke range between a minimum airflow position and a maximum airflow position and in direct proportion to actual real-time air condition demand;

at least one outside sensor capable of measuring outside air conditions and for transmitting respective stimulus dependent thereon;

at least one inside sensor capable of measuring inside air conditions and for transmitting respective stimulus dependent thereon; and an electronic control device capable of setting and storing at least one pre-set minimum absolute air condition set-point for ventilation activation, the electronic control device electrically connected to the actuator for controlling the activation thereof, the electronic control device also electrically connected to the at least one outside sensor for controlling the activation thereof and receiving stimulus therefrom, and the electronic control device also electrically connected to the at least one inside sensor for controlling the activation thereof and receiving stimulus therefrom.

3. The apparatus of claim 2, wherein the electronic control device further at least controls HVAC fan control function, and wherein the electronic control device activates an HVAC fan and the actuator to cause the transport of outside air into the inside space, thereby allowing the inside air conditions to be equilibrated with the outside air conditions; whereupon the electronic control device causes the at least one inside sensor to sense the inside equilibrated air conditions and to transmit to the electronic control device air condition stimulus dependent thereon, wherein the electronic control device sets and stores the at least one air condition set-point for ventilation activation; whereupon the electronic control device causes the at least one inside sensor to sense the inside air conditions and to transmit to the electronic control device respective air condition stimulus dependent thereon; whereupon the electronic control device compares the at least one air condition set-point for ventilation activation to an applicable sensed inside air condition; and whereupon if the sensed inside air condition is greater than the at least one air condition set-point, the electronic control device activates the actuator to cause the transport of outside air into the inside space, thereby diluting inside air conditions and maintaining the inside space at the at least one air condition set-point.

4. The apparatus of claim 3, wherein the at least one inside sensor is capable of measuring at least one contaminant level and temperature and for transmitting respective stimulus dependent thereon, wherein the electronic control device is capable of setting and storing at least one pre-set minimum absolute contaminant level set-point for ventilation activation and/or a pre-set minimum absolute temperature set-point for ventilation activation, and wherein the electronic control device activates an HVAC fan and the actuator to cause the transport of outside air into the inside space, thereby allowing the inside air conditions to be equilibrated with the outside air conditions; whereupon the electronic control device causes the at least one inside sensor to sense the equilibrated contaminant level and/or the equilibrated temperature of inside space air and to transmit to the electronic control device contaminant level stimulus and/or temperature stimulus dependent thereon, wherein the electronic control device sets and stores the at least one contaminant level set-point and/or the temperature set-point for ventilation activation; whereupon the electronic control device causes the at least one inside sensor to sense the inside contaminant level and/or the inside temperature and to transmit to the electronic control device contaminant level and/or temperature stimulus dependent thereon; whereupon the electronic control device compares the sensed inside contaminant level and/or the sensed inside temperature to the at least one contaminant level set-point and/or the temperature set-point for ventilation activation; and whereupon if the sensed contaminant level and/or the sensed temperature is greater than the at least one contaminant level set-point and/or the temperature set-point, the electronic control device activates the actuator to cause the transport of outside air into the inside space, thereby diluting inside air conditions and maintaining the inside space at the at least one contaminant level set-point and/or the temperature set-point.

5. The apparatus of claim 2, wherein the at least one inside sensor comprises a dual $CO_2$ and temperature sensor.

6. The apparatus of claim 2, wherein the electronic control device further controls HVAC system control functions, and wherein the electronic control device causes the at least one outside sensor and the at least one inside sensor to sense the respective inside air conditions and outside air conditions and to transmit to the electronic control device respective air condition stimulus dependent thereon; whereupon the electronic control device determines the absolute air condition differential between the respective sensed air conditions and compares the differential to the at least one air condition set-point for ventilation activation; and whereupon if the differential is greater than the at least one air condition set-point, the electronic control device activates the actuator to cause the transport of outside air into the inside space, thereby diluting inside air conditions and maintaining the inside space at the at least one air condition set-point.

7. The apparatus of claim 6, wherein the at least one outside sensor is capable of measuring at least one contaminant level and temperature and for transmitting respective stimulus dependent thereon, the at least one inside sensor is capable of measuring at least one contaminant level and temperature and for transmitting respective stimulus dependent thereon, wherein the electronic control device is capable of setting and storing at least one pre-set minimum absolute contaminant level set-point for ventilation activation and/or a pre-set minimum absolute temperature set-point for ventilation activation, and wherein the electronic control device causes the at least one outside sensor and the at least one inside sensor to sense respective contaminant levels and/or temperatures of inside space air and of outside space air and to transmit to the electronic control device respective contaminant level stimulus and/or temperature stimulus dependent thereon; whereupon the electronic control device determines the absolute contaminant level differential between the respective absolute contaminant levels and compares the differential to the absolute contaminant level set-point for ventilation activation, and/or the electronic control device determines the absolute temperature differential between the respective absolute temperatures and compares the differential to the absolute temperature set-point for ventilation activation; and whereupon if the contaminant level differential is greater than the contaminant level set-point, the electronic control device activates the actuator to cause the transport of outside air into the inside space, thereby diluting inside air conditions and maintaining the inside space at the contaminant level set-point, and/or if the temperature differential is greater than the temperature set-point, the electronic control device activates the actuator to cause the transport of outside air into the inside space, thereby diluting inside air conditions and maintaining the inside space at the temperature set-point.

8. The apparatus of claim 1, wherein the return portion of the HVAC system comprises a return air duct and a return portion of an HVAC unit, and wherein the housing further comprises:

a front wall adjacent to and adaptable to be coupled to the return duct or the return portion of the HVAC unit, the front wall comprising the air outlet;

a rear wall comprising a vertical outside air inlet in conjunction with a vertical outside air filter, and an inlet hood;

a right side wall, including a bushing therethrough adaptable to receive a right end of a damper shaft, and a left side wall, including a bushing therethrough adaptable to receive a left end of the damper shaft, wherein the damper shaft is retained by the bushings, and wherein a damper is coupled to the damper shaft; and a top wall and a bottom wall, the bottom wall comprising a horizontal outside air inlet in conjunction with a horizontal outside air filter.

9. The apparatus of claim 8, wherein the damper seal seals against the right wall, the left wall, the top wall, and the at least one restrictor plate.

10. The apparatus of claim 8 further comprising:

an actuator for automatically shifting the damper, upon receiving an appropriate stimulus, to any position in a damper stroke range between a minimum airflow position and a maximum airflow position and in direct proportion to actual real-time air condition demand;

at least one outside sensor capable of measuring outside air conditions and for transmitting respective stimulus dependent thereon;

at least one inside sensor capable of measuring inside air conditions and for transmitting respective stimulus dependent thereon; and an electronic control device capable of setting and storing at least one pre-set minimum absolute air condition set-point for ventilation activation, the electronic control device electrically connected to the actuator for controlling the activation thereof, the electronic control device also electrically connected to the at least one outside sensor for controlling the activation thereof and receiving stimulus therefrom, and the electronic control device also electrically connected to the at least one inside sensor for controlling the activation thereof and receiving stimulus therefrom; and wherein a removable control cabinet cover and an underlying control cabinet form a portion of the right or the left side wall, wherein the electronic control device and the actuator are located in the underlying control cabinet, and wherein the outside air sensor is mounted through the underlying cabinet, thereby protruding into the inner chamber.

11. The apparatus of claim 10, wherein the electronic control device further at least controls HVAC fan control function, and wherein the electronic control device activates an HVAC fan and the actuator to cause the transport of outside air into the inside space, thereby allowing the inside air conditions to be equilibrated with the outside air conditions; whereupon the electronic control device causes the at least one inside sensor to sense the inside equilibrated air conditions and to transmit to the electronic control device air condition stimulus dependent thereon, wherein the electronic control device sets and stores the at least one air condition set-point for ventilation activation; whereupon the electronic control device causes the at least one inside sensor to sense the inside air conditions and to transmit to the electronic control device respective air condition stimulus dependent thereon; whereupon the electronic control device compares the at least one air condition set-point for ventilation activation to an applicable sensed inside air condition; and whereupon if the sensed inside air condition is greater than the at least one air condition set-point, the electronic control device activates the actuator to cause the transport of outside air into the inside space, thereby diluting inside air conditions and maintaining the inside space at the at least one air condition set-point.

12. The apparatus of claim 10, wherein the electronic control device further controls HVAC system control functions, and wherein the electronic control device causes the at least one outside sensor and the at least one inside sensor to sense the respective inside air conditions and outside air conditions and to transmit to the electronic control device respective air condition stimulus dependent thereon; whereupon the electronic control device determines the absolute air condition differential between the respective sensed air conditions and compares the differential to the at least one air condition set-point for ventilation activation; and whereupon if the differential is greater than the at least one air condition set-point, the electronic control device activates the actuator to cause the transport of outside air into the inside space, thereby diluting inside air conditions and maintaining the inside space at the at least one air condition set-point.

13. The apparatus of claim 1, wherein the return portion of the HVAC system comprises a return air duct and a return portion of an inside air handler, and wherein the housing further comprises:

a front wall adjacent to and adaptable to be coupled to a downstream side of an outside air duct, the return air duct, or the return portion of the inside air handler, the front wall comprising the air outlet;

a rear wall adjacent to and adaptable to be coupled to the outside air duct, the rear wall comprising a vertical outside air inlet in conjunction with a vertical outside air filter;

a right side wall, including a bushing therethrough adaptable to receive a right end of a damper shaft, and a left side wall, including a bushing therethrough adaptable to receive a left end of the damper shaft, wherein the damper shaft is retained by the bushings, and wherein the damper is coupled to the damper shaft; and a top wall and a bottom wall.

14. The apparatus of claim 13, wherein the damper seal seals against the right wall, the left wall, the top wall, and the at least one restrictor plate.

15. The apparatus of claim 13 further comprising:

an actuator for automatically shifting the damper, upon receiving an appropriate stimulus, to any position in a damper stroke range between a minimum airflow position and a maximum airflow position and in direct proportion to actual real-time air condition demand;

at least one outside sensor capable of measuring outside air conditions and for transmitting respective stimulus dependent thereon;

at least one inside sensor capable of measuring inside air conditions and for transmitting respective stimulus dependent thereon; and an electronic control device capable of setting and storing at least one pre-set minimum absolute air condition set-point for ventilation activation, the electronic control device electrically connected to the actuator for controlling the activation thereof, the electronic control device also electrically connected to the at least one outside sensor for controlling the activation thereof and receiving stimulus therefrom, and the electronic control device also electrically connected to the at least one inside sensor for controlling the activation thereof and receiving stimulus therefrom; and wherein a removable control cabinet cover and an underlying control cabinet form a portion of the right or the left side wall, wherein the electronic control device and the actuator are located in the underlying control cabinet, and wherein the outside air sensor is mounted through the underlying cabinet, thereby protruding into the inner chamber.

16. The apparatus of claim 15, wherein the electronic control device further at least controls HVAC fan control function, and wherein the electronic control device activates an HVAC fan and the actuator to cause the transport of outside air into the inside space, thereby allowing the inside air conditions to be equilibrated with the outside air conditions; whereupon the electronic control device causes the at least one inside sensor to sense the inside equilibrated air conditions and to transmit to the electronic control device air condition stimulus dependent thereon, wherein the electronic control device sets and stores the at least one air condition set-point for ventilation activation; whereupon the electronic control device causes the at least one inside sensor to sense the inside air conditions and to transmit to the electronic control device respective air condition stimulus dependent thereon; whereupon the electronic control device compares the at least one air condition set-point for ventilation activation to an applicable sensed inside air condition; and whereupon if the sensed inside air condition is greater than the at least one air condition set-point, the electronic control device activates the actuator to cause the transport of outside air into the inside space, thereby diluting inside air conditions and maintaining the inside space at the at least one air condition set-point.

17. The apparatus of claim 15, wherein the electronic control device further controls HVAC system control functions, and wherein the electronic control device causes the at least one outside sensor and the at least one inside sensor to sense the respective inside air conditions and outside air conditions and to transmit to the electronic control device respective air condition stimulus dependent thereon; whereupon the electronic control device determines the absolute air condition differential between the respective sensed air conditions and compares the differential to the at least one air condition set-point for ventilation activation; and whereupon if the differential is greater than the at least one air condition set-point, the electronic control device activates the actuator to cause the transport of outside air into the inside space, thereby diluting inside air conditions and maintaining the inside space at the at least one air condition set-point.

* * * * *